US008251713B2

(12) United States Patent
Lin et al.

(10) Patent No.: US 8,251,713 B2
(45) Date of Patent: Aug. 28, 2012

(54) CONTACT TERMINAL HAVING INSULATIVE CAP

(75) Inventors: Nan-Hung Lin, New Taipei (TW); Chun-Yi Chang, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/096,984

(22) Filed: Apr. 28, 2011

(65) Prior Publication Data

US 2011/0269344 A1 Nov. 3, 2011

(30) Foreign Application Priority Data

Apr. 28, 2010 (TW) ..... 99207748 U

(51) Int. Cl.
*H01R 12/00* (2006.01)

(52) U.S. Cl. ..... 439/71

(58) Field of Classification Search ..... 439/71, 439/68, 70, 83
See application file for complete search history.

(56) References Cited

U.S. PATENT DOCUMENTS

| | | | | |
|---|---|---|---|---|
| 3,399,372 | A * | 8/1968 | Uberbacher | 439/60 |
| 4,502,747 | A * | 3/1985 | Bright et al. | 439/296 |
| 4,511,197 | A * | 4/1985 | Grabbe et al. | 439/69 |
| 4,921,430 | A * | 5/1990 | Matsuoka | 439/72 |
| 5,018,981 | A * | 5/1991 | Matsuoka | 439/71 |
| 5,169,321 | A * | 12/1992 | Matsuoka | 439/71 |
| 5,545,045 | A * | 8/1996 | Wakamatsu | 439/70 |
| 6,478,586 | B1 * | 11/2002 | Ma | 439/79 |
| 6,908,313 | B2 | 6/2005 | Walkup et al. | |
| 7,621,755 | B2 * | 11/2009 | Kubo et al. | 439/66 |
| 7,748,991 | B2 * | 7/2010 | Nikaido et al. | 439/71 |
| 2003/0203664 | A1 * | 10/2003 | Koopman et al. | 439/71 |
| 2004/0266227 | A1 * | 12/2004 | Ma | 439/71 |
| 2005/0020101 | A1 * | 1/2005 | Deng | 439/71 |
| 2009/0068895 | A1 * | 3/2009 | Millard et al. | 439/626 |

* cited by examiner

*Primary Examiner* — Amy Cohen Johnson
*Assistant Examiner* — Vladimir Imas
(74) *Attorney, Agent, or Firm* — Andrew C. Cheng; Wei Te Chung; Ming Chieh Chang

(57) ABSTRACT

An electrical connector includes an insulative housing and a plurality of contacts received in the housing. Each contact has a base portion, a resilient arm and a contacting portion located at one end of the resilient arm. The contacting portion has a free end attached with an insulative member so as to prevent short circuit with an adjacent contact.

17 Claims, 4 Drawing Sheets

CONTACT TERMINAL HAVING INSULATIVE CAP

BACKGROUND OF THE INVENTION

1. Field of the Invention

The present invention relates to a contact terminal, and more particularly to a contact terminal having an insulative cap. The present invention also relates to a fine pitch connector where risk of short-circuit between two adjacent contact terminal can be properly avoided.

2. Description of Related Art

Electrical connectors are widely used in various electrical devices for establishing electrical connection between two electronic members, such as an IC (Integrated Circuit) package and a PCB (Printed Circuit Board).

The electrical connector generally includes an insulative housing and a larger number of contacts received in the housing and arranged in rows and columns. With rapid development of technology, the electrical connector is designed with more and more small profile, and the pitch of the contacts is also subject to be decreased. The contacts deflect and move toward one another when engage with an electronic device. In worst scenario, physical contact and short circuit between adjacent contacts may occur due to the deflection of the contacts, thereby destroying the electrical connection with the electronic device.

Typically, as disclosed in U.S. Pat. No. 6,908,313, an electrical socket for interconnecting an LGA chip with a PCB includes an insulative housing (2) and a multiplicity of terminals (1). The housing includes a plurality of passageways (26) extending therethrough for engagingly accommodating corresponding terminals. Each terminal includes a locating plate (10) arranged in rows, and a mating beam (12) connected to the locating plate and extending along the corresponding row. The terminals and the mating beams are arranged so that a projection A of each mating beam along the corresponding row is longer than a distance B between each two adjacent locating plates of two adjacent terminals arranged in the same row. Accordingly, when the mating beams are engaged with electrodes of the LGA chip, the mating beams are long enough to provide excellent resilient deflection characteristics, thereby ensuring good mechanical and electrical connection between the mating beams and the electrodes. As illustrated in FIGS. 1-9, it can be readily seen that two adjacent contact terminals are overlapped along vertical direction so as to meet the fine-pitch requirements. As a result, the risk of short-circuiting between two adjacent contact terminals are therefore raised.

In view of the above, an improved contact is desired to overcome the above-mentioned problem.

SUMMARY OF THE INVENTION

Accordingly, an object of the present invention is to provide an improved electrical connector having short circuit-free contacts.

According to one aspect of the present invention, there is provided an electrical connector which includes an insulative housing and a plurality of contacts received in the housing. Each contact has a base portion, a resilient arm and a contacting portion located at one end of the resilient arm. The contacting portion has a free end attached with an insulative member so as to prevent short circuit with an adjacent contact.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
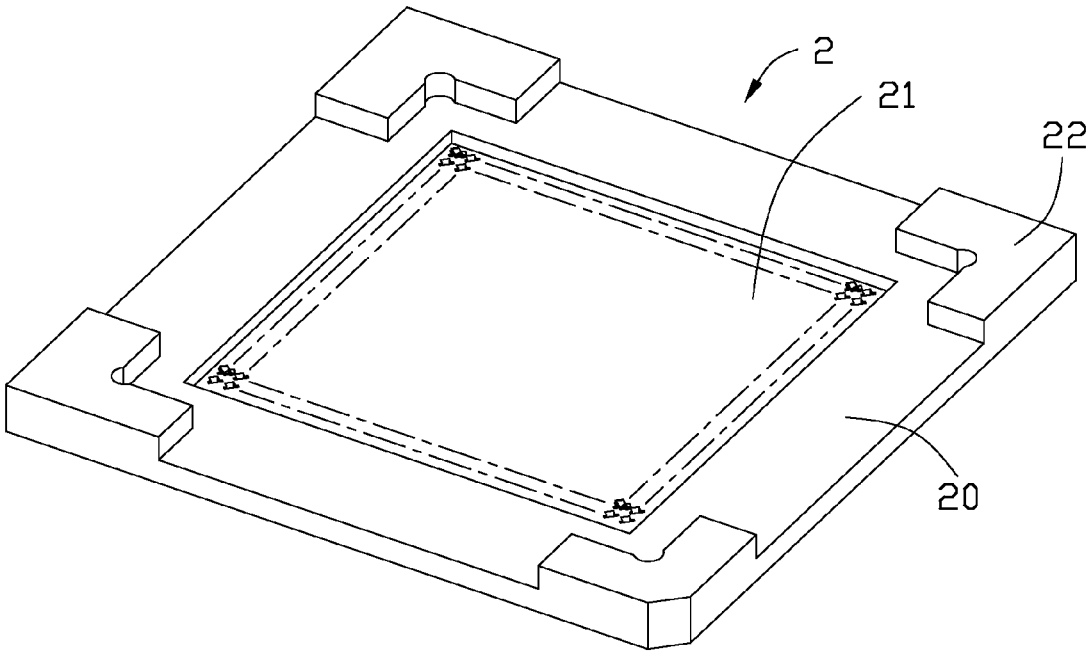
FIG. 1 is a perspective view of an electrical connector in accordance with a preferred embodiment of the present invention.
Figure 3:
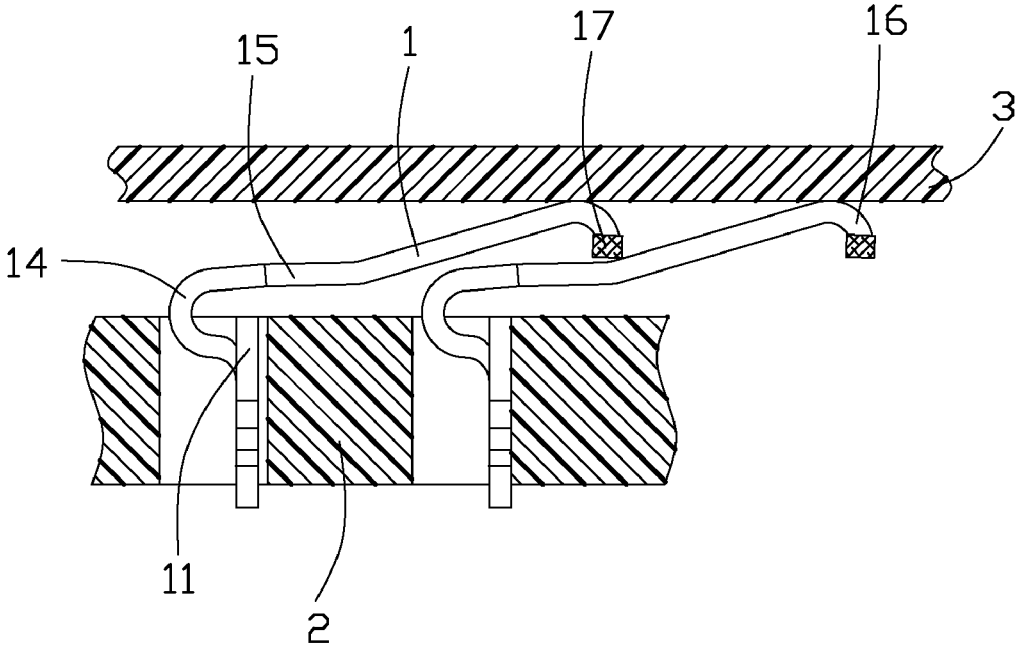
FIG. 3 is a side view illustrating the contacts as shown in FIG. 2 engaging with an IC package.

Referring to FIG. 1 and FIG. 3, an electrical connector made in accordance with the present invention is used to interconnect an IC package 3 and a PCB (not shown). The electrical connector includes an insulative housing 2 and a plurality of contacts 1 received in the housing 2.

Particularly referring to FIG. 1, the insulative housing 2 is integrally molded and has a rectangular shape. The housing 2 includes a base 20 and a mating port 21 located at a central position of the base 20 and defining an array of passageways (not labeled) for receiving contacts 1. Four positioning blocks 22 respectively extends upwardly from four corners of the base 20 for positioning the IC package 3.

Figure 2:
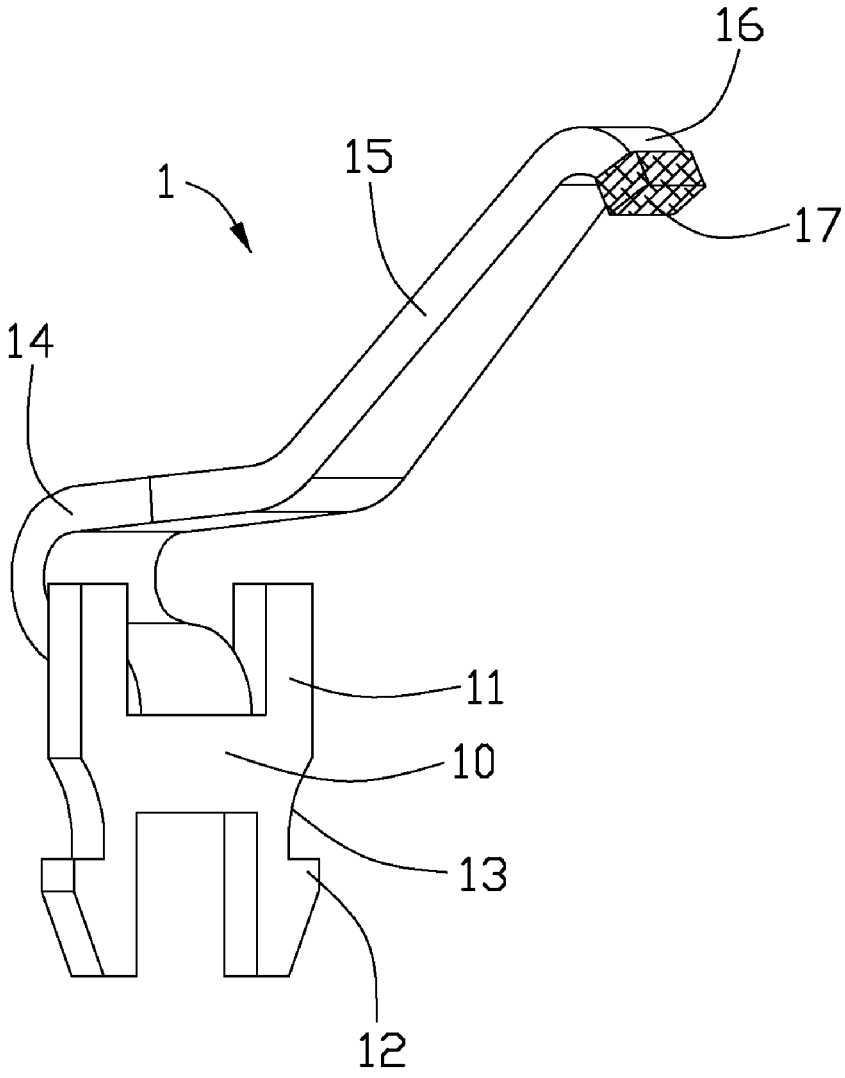
FIG. 2 is a perspective view of a contact of the electrical connector as shown in FIG. 1.
Figure 4:
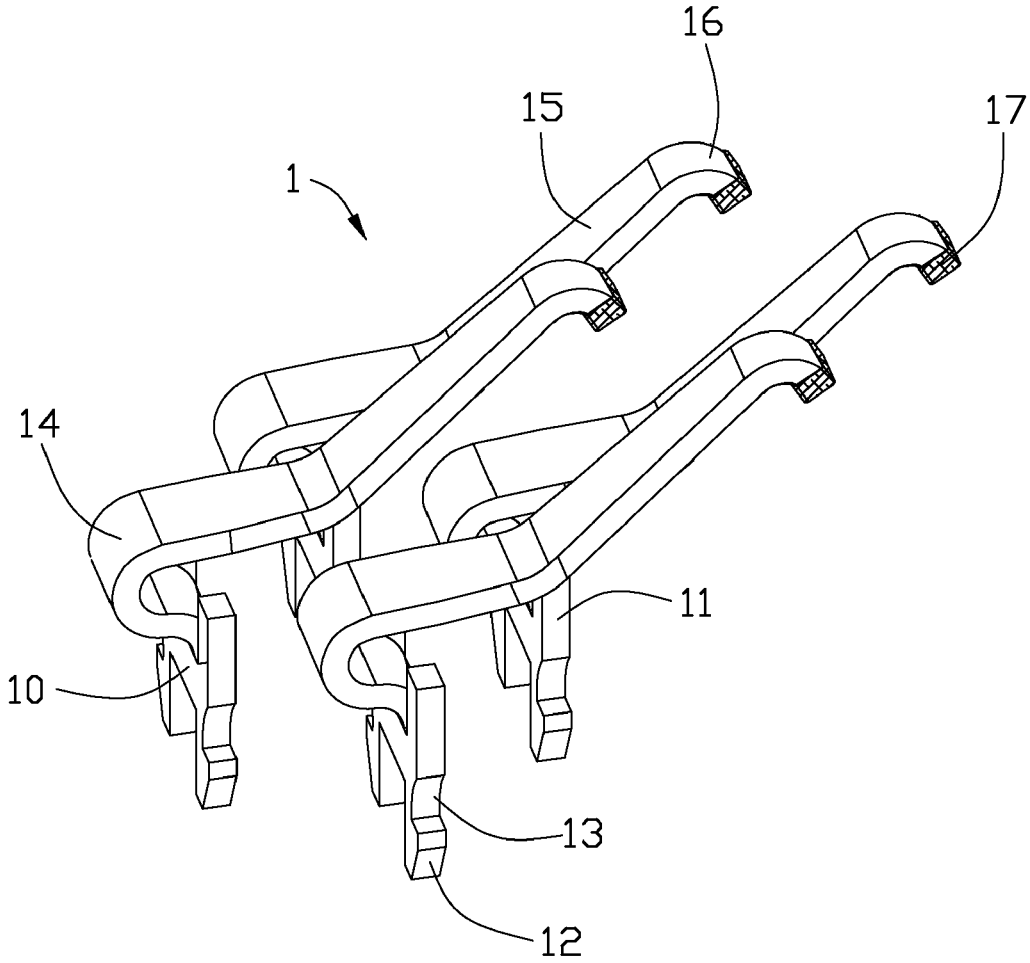
FIG. 4 is a perspective view of an array of the contacts as shown in FIG. 2.

Particularly referring to FIGS. 2 and 4, the contact 1 is made by stamping and bending a metal sheet. The contact 1 includes a base portion 10 and a pair of retaining portions 11 extending vertically at opposite sides of the base portion 10 and coplanar with the base portion 10. The retaining portions 11 are respectively formed with barbs 12 facing opposite to each other. A notch 13 is formed above the barb 12 to increase the elasticity of the barb 12. A bending portion 14 extends rearwardly from the base portion 10 and then extends forwardly such that a U-shape thereof is formed. A resilient arm 15 extends upwardly and obliquely from the U-shaped bending portion 14. A domed contacting potion 16 is formed at the end of the resilient arm 15 and has a free end extending downwardly. The free end of the contacting portion 16 is plated with an insulative layer 17. Particularly referring to FIG. 4, a contacting portion 16 is located above a resilient arm 15 of an adjacent contact 1.

Particularly referring to FIG. 3, when the contacting portion 16 is over pressed by the IC package 3, the contacting portion 16 moves toward the resilient arm 15 of the adjacent contact 1 and is likely to come into contact with the resilient arm 15. In such a case, the insulative layer 17 works and prevents potential short circuit between the adjacent contacts 1.

In an alternative embodiment, an insulative cap, rigid or soft, is employed in stead of the plated insulative layer to cover the free end of the contacting portion of the contact. Similar performance could be achieved.

While preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector used for electrically connecting a mating electrical component having conductive pads to a printed circuit board, comprising:

an insulative housing defining a mating port for receiving the mating electrical component; and a plurality of contacts retained in the insulative housing, each contact comprising a base portion fixed in the housing, a resilient arm obliquely extending from the base portion and a soldering portion for connecting to the printed circuit board; wherein at least one of the resilient arm defines an undersurface vertically facing the resilient arm of an adjacent contact and the at least one of the resilient arms is arranged with an insulative member on the undersurface thereof such that short-circuit with respect to the resilient arm of the adjacent contact is avoided.

2. The electrical connector as claimed in claim 1, wherein the at least one of the resilient arm comprises a contacting portion formed at a free end thereof and the free end bends downwardly.

3. The electrical connector as claimed in claim 1, wherein each contact comprises a pair of H-shaped retaining portions located at opposite sides of the base portion and coplanar with the base portion.

4. The electrical connector as claimed in claim 1, wherein each contact comprises a U-shaped bending portion interconnecting the resilient arm and the base portion.

5. The electrical connector as claimed in claim 1, wherein the at least one of the resilient arm is substantially parallel to the resilient arm of the adjacent contact while a free end of the at least one of the resilient arm is located directly over the resilient arm of the adjacent contact in a vertical direction.

6. The electrical connector as claimed in claim 1, wherein the insulative member is in a manner of insulative layer that is plated on the undersurface.

7. The electrical connector as claimed in claim 1, wherein the contacts are arranged in the insulative housing in rows and columns, and the resilient arms of the adjacent contacts along the same row at least partly overlap with each other along a vertical direction.

8. An electrical connector, comprising:

an insulative housing; and an array of contacts received in the housing, each contact having an obliquely extending arm which is formed with a backside and a free end, the free end overlapping a backside of an adjacent contact and movable toward the same when the arm is deflected;

wherein either the backside or the free end is disposed with an insulative member such that short circuit between two adjacent contacts is avoided.

9. The electrical connector as claimed in claim 8, wherein the extending arm has a dome-shaped contacting portion at one end thereof, and the insulative member is attached on the free end of the dome-shaped contacting portion.

10. The electrical connector as claimed in claim 9, wherein the insulative member is in a manner of insulative layer that is plated on the free end of the contact.

11. An electrical connector for use with an electronic package, comprising:

an insulative housing;

a plurality of contacts embedded in the housing with deflectable contacting sections extending out of the housing for contacting the electronic package;

the contacting section of each of said contacts being applied with insulative material on an underside of a specific position where is downwardly closest to the corresponding contacting section of an adjacent contact thereunder when the contacting sections of all the contacts are downwardly deflected by the electronic package for preventing short-circuit therebetween.

12. The electrical connector as claimed in claim 11, wherein said specific position is located around a tip of the contacting section.

13. The electrical connector as claimed in claim 11, wherein a contact point of the contacting section of each of said contacts with the electronic package, is proximal to said specific position.

14. The electrical connector as claimed in claim 11, wherein the contact and the corresponding adjacent contact are neighboring with each other in a direction along which the contacting section of the contact extends.

15. The electrical connector as claimed in claim 11, wherein said contacts are arranged in the insulative housing in rows and columns, and the contacting sections of the adjacent contacts along the same row at least partly overlap with each other along a vertical direction.

16. The electrical connector as claimed in claim 11, wherein the specific position is downwardly closest to the corresponding contacting section of an adjacent contact thereunder in a vertical direction.

17. The electrical connector as claimed in claim 11, wherein said short-circuit prevention occurs between the two adjacent contacts in a same row of which the corresponding contacting section essentially extends in a same direction in a top view.

* * * * *